US007746211B2

(12) United States Patent
Pokharna et al.

(10) Patent No.: US 7,746,211 B2
(45) Date of Patent: Jun. 29, 2010

(54) LAMP TRANSFORMER ASSEMBLY

(75) Inventors: Rajendra K. Pokharna, Ellicott City, MD (US); Viktor K. Varga, Solon, OH (US); Tony Aboumrad, Parma, OH (US)

(73) Assignee: General Electric Company, Schenectady, NY (US)

( * ) Notice: Subject to any disclaimer, the term of this patent is extended or adjusted under 35 U.S.C. 154(b) by 696 days.

(21) Appl. No.: 11/645,879

(22) Filed: Dec. 27, 2006

(65) Prior Publication Data

US 2008/0157914 A1 Jul. 3, 2008

(51) Int. Cl.

| | |
|---|---|
| ***H01F 27/28*** | (2006.01) |
| ***H01F 17/06*** | (2006.01) |
| ***H01F 5/00*** | (2006.01) |
| ***H01F 27/24*** | (2006.01) |

(52) U.S. Cl. ..... 336/229; 336/178; 336/200; 336/212

(58) Field of Classification Search ..... 336/178, 336/200, 212, 229

See application file for complete search history.

(56) References Cited

U.S. PATENT DOCUMENTS

| | | | | |
|---|---|---|---|---|
| 4,782,582 | A * | 11/1988 | Venezia | 29/605 |
| 4,940,921 | A * | 7/1990 | Helling et al. | 315/219 |
| 6,104,585 | A * | 8/2000 | Matsui et al. | 361/38 |
| 6,194,834 | B1 | 2/2001 | Seiler et al. | |
| 6,201,350 | B1 * | 3/2001 | Okuchi et al. | 315/82 |
| 6,243,940 | B1 * | 6/2001 | Rund et al. | 29/608 |
| 6,462,476 | B1 * | 10/2002 | Hirschmann et al. | 315/58 |
| 6,531,946 | B2 * | 3/2003 | Abe et al. | 336/213 |
| 6,731,076 | B1 | 5/2004 | Gerhard et al. | |
| 7,042,169 | B2 | 5/2006 | Neumeier et al. | |
| 2004/0066150 | A1 | 4/2004 | Neumeier et al. | |
| 2004/0108929 | A1 * | 6/2004 | Ichikawa et al. | 336/83 |
| 2006/0255747 | A1 | 11/2006 | Ichikawa et al. | |

FOREIGN PATENT DOCUMENTS

| | | | |
|---|---|---|---|
| DE | 19751548 | C2 | 6/1999 |
| DE | 10159112 | A1 | 6/2003 |
| EP | 0 188 095 | | 7/1986 |
| GB | 343928 | | 2/1931 |
| GB | 2037089 | A * | 7/1980 |
| JP | 61 084011 | A | 4/1986 |

(Continued)

OTHER PUBLICATIONS

English translation of GB 2037089 A Jul. 1980.*

(Continued)

*Primary Examiner*—Elvin G Enad
*Assistant Examiner*—Ronald W Hinson
(74) *Attorney, Agent, or Firm*—Fay Sharpe LLP

(57) ABSTRACT

Disclosed is a lamp transformer assembly, transformer winding arrangement and method of assembling a transformer assembly and lamp igniter transformer core. The lamp transformer assembly comprises a transformer core comprising two or more core members, wherein the core members ends are adapted to provide a transformer core with axially distributed air gaps. Furthermore, the transformer assembly comprises a primary and secondary winding, wherein one or more core members and the secondary winding are adapted to provide insertion of the one or more core members within the interior of the secondary winding. The transformer core members are attached to complete the core.

30 Claims, 10 Drawing Sheets

FOREIGN PATENT DOCUMENTS

| | | | |
|---|---|---|---|
| JP | 10 308315 | A | 11/1998 |
| JP | 11 340068 | A | 12/1999 |
| WO | WO 98/41998 | | 9/1998 |

OTHER PUBLICATIONS

PCT/US2007/084795 International Search Report, mailed Oct. 21, 2008.

Colonel WM. T. McLyman; "Transformer and Inductor Design Handbook"; Second Edition Revised and Expanded; Copyright 1988, pp. 35-45, by Marcel Dekker, Inc., New York, New York.

* cited by examiner

LAMP TRANSFORMER ASSEMBLY

BACKGROUND OF THE INVENTION

This disclosure relates to a high voltage lamp transformer assembly, winding arrangement and method of assembly. Specifically, the disclosed high voltage lamp transformer assembly can be mounted within an automotive headlamp module, for example a D1 or D5 automotive headlamp module. The disclosed transformer assembly and winding arrangement is particularly well suited as a high voltage lamp igniter transformer for lamp applications requiring a relatively large amount of current during ignition while maintaining a relatively small transformer size.

Conventionally, high voltage igniter circuits are used to start HID lamps. One example of a HID lamp requiring a high voltage ignition is an automotive lamp commonly referred to as a headlamp. To produce the high voltage ignition signal, an igniter circuit is operatively connected to the HID lamp. The igniter circuit typically includes a lead frame and a high voltage transformer arrangement. The high voltage transformer is necessary to produce the required lamp ignition high voltage signal, which may be as high as 30 kV. For purposes of this disclosure, high voltage refers to voltages in the approximate range of 1 kV-30 kV and low voltage refers to voltages less than 1 kV.

U.S. Patent Application Publication 2004/0066150 discloses a gas discharge lamp base comprising a conventional ignition circuit. The housing includes a compartment within the housing to contain a high voltage ignition bar core transformer which is mounted to a lead frame (FIG. 3). The igniter module is connected to a DC source via a connector which may be molded directly to the housing.

U.S. Pat. No. 6,731,076 discloses another conventional gas discharge lamp base and associated components. The gas discharge lamp base comprises a carrier part (16) which carries electrical components and a toroidal core transformer (23) to ignite a gas discharge lamp (2). The toroidal shape of the transformer provides clearance for a housing top part (10) including an attached lamp mounting base to pass through the center of the toroid transformer.

Other examples of conventional shaped transformer cores include a core comprising a magnetic material with an open end, producing a "c" shaped or horseshoe shaped core. The open space at the longitudinal ends of the core can be coupled with a gap material to control the saturation of the transformer core, for example, air and/or epoxy.

This disclosure provides a lamp transformer assembly, winding arrangement, and method of assembly for use in a lamp module, for example a high voltage lamp ignition module. As compared to conventional lamp igniter transformers, this disclosure and embodiments herein provide a transformer core construction which can increase the saturation threshold of a transformer core and provide an increase in current delivered to a lamp from the transformer assembly.

BRIEF DESCRIPTION OF THE INVENTION

A lamp transformer assembly is disclosed. The lamp transformer assembly comprises a transformer core comprising two or more core members; and two or more gaps; and a primary winding and a secondary winding. The primary winding comprises one or more winding turns and the secondary winding comprises a plurality of turns, wherein one or more core members are adapted to be inserted within the interior of one or both of the primary and secondary windings, and the two or more core members are positioned relative to one another across the two or more gaps and two or more gaps to operatively provide a continuous core, wherein the two or more core members are adapted to be positioned relative to one or more of their respective gaps after one or more core members have been inserted within the interior of one or both of the primary and secondary windings.

The secondary winding may comprise a flat insulated conductor having a defined width and thickness, the width greater than the thickness, and the flat insulated conductor is positioned relative to the transformer core to align the width in a direction substantially perpendicular to the surface of the transformer core.

A method of assembling a lamp transformer assembly is also disclosed, where the lamp transformer assembly comprises first and second transformer core members; and a helically wound insulated conductor. The method comprises inserting a first end of the first core member into a first end of the helically wound insulated conductor; inserting a first end of the second core member into a second end of the helically wound insulated conductor; attaching the first end of the first core member to the first end of the second core member with a nonmagnetic gap material to produce a first gap; and attaching the second end of the first core member to the second end of the second core member with a nonmagnetic material to produce a second gap.

The method may further comprise inserting the transformer assembly into a housing wherein a housing lamp lead encasement extends through the transformer assembly; and potting the transformer assembly in the housing, where the potting material substantially covers the transformer core, primary windings and secondary windings.

DETAILED DESCRIPTION OF THE INVENTION

This disclosure provides a lamp transformer assembly, winding arrangement and method of assembly for producing a high voltage lamp signal, for example, a lamp ignition signal.

Figure 1:
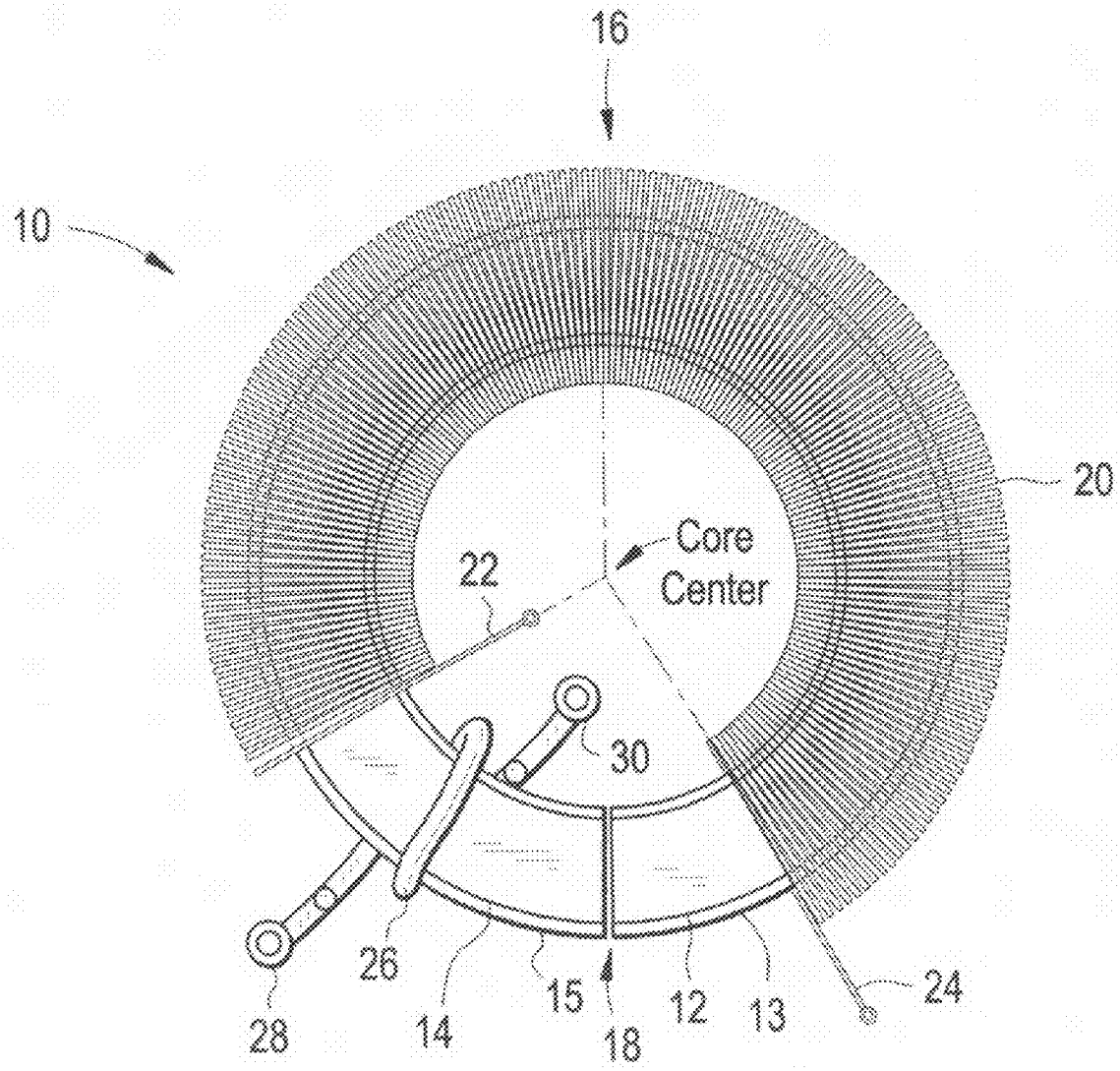
FIG. 1 is an illustration of a lamp igniter toroidal shaped transformer according to an exemplary embodiment of this disclosure.

With reference to FIG. 1, illustrated is a lamp igniter toroidal shaped transformer 10. The toroidal shaped transformer 10 preferably comprises a first core member 12, a second core member 14, an insulated primary winding 26, an insulated secondary winding 20, a first gap 16 and a second gap 18. The first and second core members 12, 14, are preferably a substantially magnetic material and are coated with an insulating material 13, 15, respectively. An example of a preferred core material includes iron and an example of an insulating material includes Polene, although it will be appreciated that other functionally similar material may be used without departing from the scope and intent of the present disclosure. The primary winding has a relatively small number of turns about the core members and opposite ends form a primary winding first lead 28 and a primary winding second lead 30. As is known, the primary winding typically encompasses the core members in a wrapped, helical fashion with the core members situated within the primary winding. The secondary winding has a relatively large number of turns with opposite ends being referred to as a secondary winding first lead 22 and a secondary winding second lead 24. Notably, the lamp transformer has two gaps 16, 18 between the core members as illustrated. Here, the gaps are symmetrically distributed; however, this disclosure is not limited to symmetrically located air gaps. For example, the gaps may be asymmetrically distributed within the core arrangement.

Figure 2:
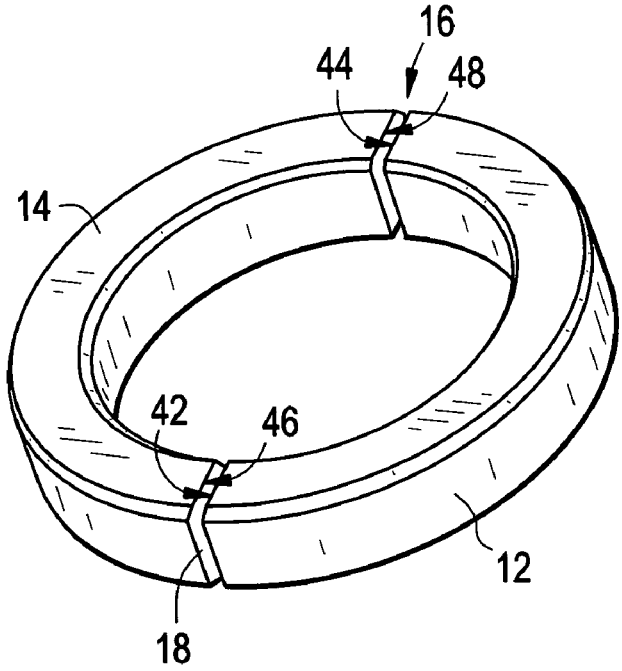
FIG. 2 is an illustration of a toroidal shaped transformer core with two axially distributed air gaps according to an exemplary embodiment of this disclosure.

In FIG. 1 and FIG. 2, the first and second core members 12 and 14 are each generally C-shaped and when positioned relative to one another (i.e., when free ends of one core member are positioned adjacent free ends of the other core member) form a toroidal core having a first gap 16 and a second gap 18. Each core member has a first end face 42, 46, and a second end face 44, 48, along the cross-sectional extent of each core member. The first and second end faces of each core member are positioned, or located or aligned, opposite each other forming gaps 16 and 18. The core members 12, 14 are held in relative position to each other through the use of an adhesive gap material applied to the end faces. This first gap 16 and second gap 18 are preferably axially distributed relative to the transformer core center. The gap material provides bonding of the first core member 12 and second core member 14 to form a toroidal shaped transformer core. Examples of gap material include nonmagnetic material with adhesive properties such as glue or epoxy with or without air encapsulated within the material. In addition, glass beads may be added to the gap material to control the overall geometric dimensions of the gap(s). Other ways of controlling a saturation threshold of the transformer core as related to the gaps, includes variations of the gap volume and the number of axially distributed gaps utilized within the transformer core.

In one exemplary embodiment of the high voltage transformer as illustrated in FIG. 1, the primary winding 26 is pre-wound a small number of turns, e.g., one or two turns, and the secondary winding 20 is pre-wound a substantially larger number of turns, e.g., 180 turns, around the core. Subsequently, the core members are placed inside the windings. The windings are coated with an insulating material, for example having a dielectric strength of 6 kV or greater. The secondary winding 20 encompasses the first gap 16 and extends approximately 270° around the completed toroidal shaped core assembly comprising the first core member 12 and second core member 14. The primary winding 26 and second air gap 18 are located between the ends of the secondary windings. In addition, the primary winding 26 and secondary winding 20 are positioned whereby the primary winding 26 is located between the secondary winding high voltage lead 24 end and the second gap 18, as illustrated in FIG. 1. Moreover, the primary winding is located substantially near the other secondary winding end which is associated with the secondary winding low voltage lead 22 end, for example, abutting the other secondary winding end.

One exemplary embodiment of a transformer according to this disclosure includes a split core arrangement where the completed core dimensions include an outside diameter (OD) of approximately 1.323" (33.6 mm), an inside diameter (ID) of approximately 0.856" (21.74 mm), and a core thickness of 0.236" (6 mm). Notably, other toroidal and partly toroidal shaped core configurations are within the scope of this disclosure. For example, a "c" shaped core or horseshoe shaped core including two or more axially distributed gaps where the gaps are a nonmagnetic material and having different dimensional relationships than the exemplary embodiment are recognized to be within the purview of the present disclosure.

To facilitate a relatively simple transformer assembly process, the core members 12, 14 are sized to be independently threaded through the primary winding 26 and the secondary winding 20. That is, the central openings in the windings 26, 20 are slightly greater than the external dimensions of the core members. The first and second end faces of each core member 12, 14 are bonded by means of adhesive applied to the end faces and filling the gaps 16, 18 after being threaded into the secondary winding 20. The primary winding 26 is preferably a circular cross-section, although other cross-sectional configurations may be desires. The secondary winding 20 is helically wound prior to the insertion or threading of the core members 12, 14 and the inner diameter of the wound windings receive the core members 12, 14 therethrough. After the primary and secondary windings have been positioned or located around the core and bonding of the core members 12, 14 to their respective gaps, the windings are fixed to the core to hold or maintain the position relative to the gaps 14, 16. One means for fixing windings to the completed core includes an adhesive or glue. Notably, the pre-wound primary winding 26 may be placed around the core before bonding the core members or the primary winding 26 may be wound around the completed core.

Figure 3:
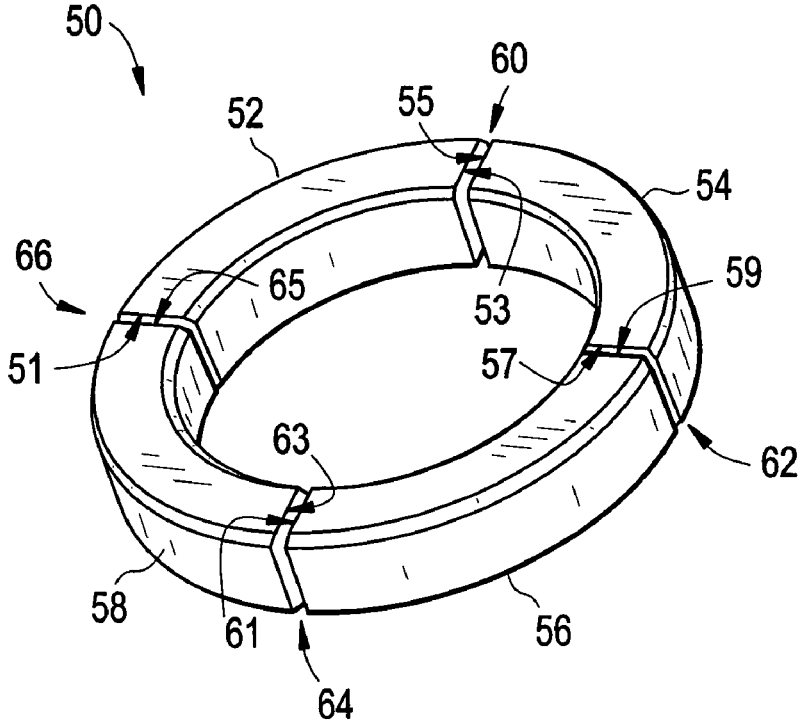
FIG. 3 is an illustration of a toroidal shaped transformer core with four axially distributed air gaps according to an exemplary embodiment of this disclosure.

With reference to FIG. 3, illustrated is another transformer core 50 having a first core member 52, a second core member 54, a third core member 56 and a fourth core member 58. First core member has end faces 51, 53, and likewise second core member has end faces 55, 57, third core member has end faces 59, 61, and fourth core member has end faces 63, 65. First, second, third and fourth gaps 60, 62, 64, 66 are defined between adjacent end faces of the core members when the core members are positioned relative to one another to form a toroid shape. The core members and gaps are configured to provide a toroidal shaped transformer core with axially distributed air gaps that are symmetrically distributed within the core; however, this exemplary embodiment may include asymmetrically distributed gaps within the core. Other variations of the toroidal shaped transformer core illustrated in FIG. 3 include a five, six, seven, eight, nine or ten gap core, where the number of core members required to produce the air gaps will be similarly five, six, seven, eight, nine and ten core members, respectively. The materials utilized to construct the transformer cores described with reference to FIG. 3 have been described with reference to FIG. 1.

Figure 4:
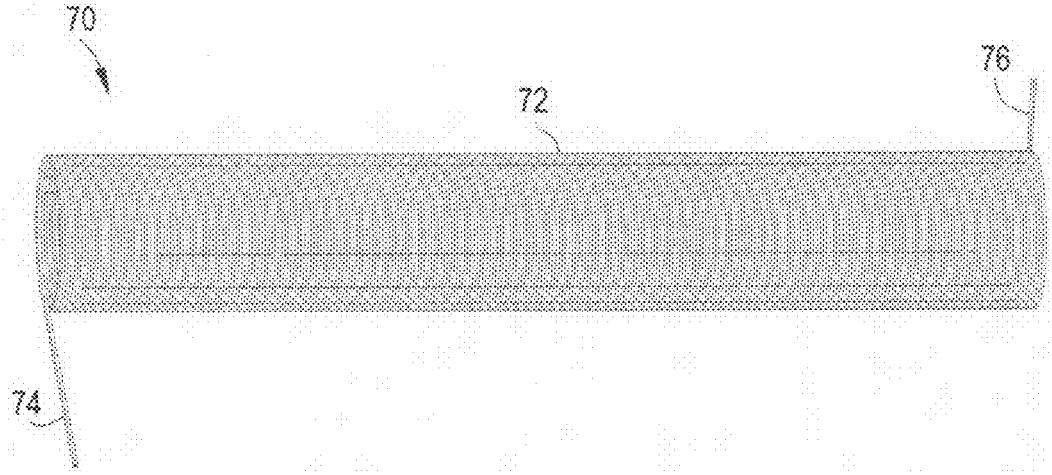
FIG. 4 is an illustration of a transformer secondary winding according to an exemplary embodiment of this disclosure.
Figure 5:
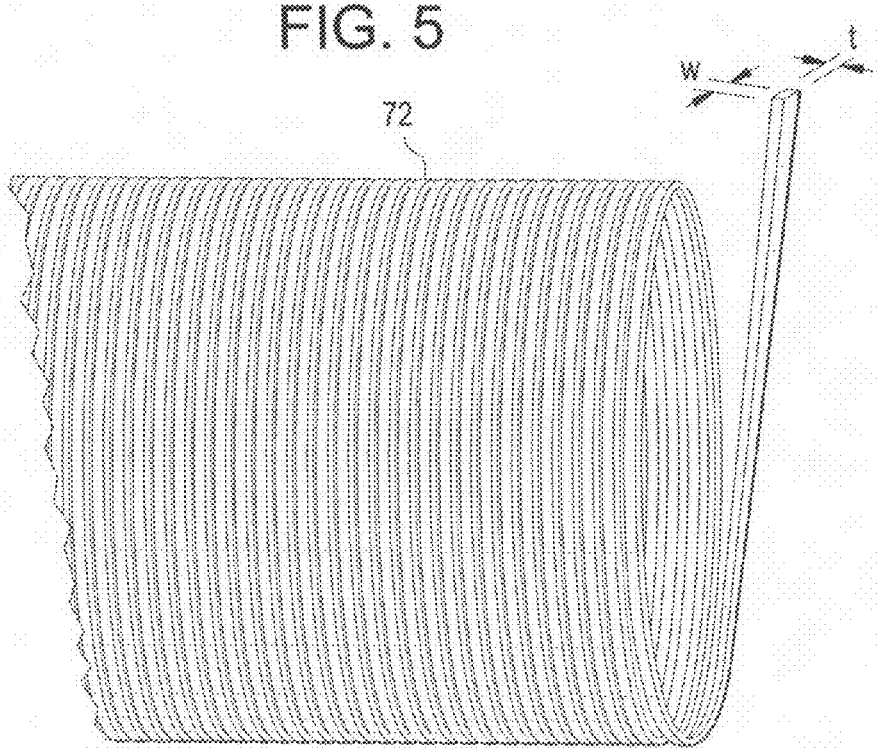
FIG. 5 is an enlarged view of an end of the transformer secondary winding illustrated in FIG. 4.

A transformer helically wound secondary winding 70 is shown in FIGS. 4-5. Specifically, FIG. 4 illustrates a secondary winding wherein a secondary winding body 72 is formed by the helical wrapping between free or terminal ends of the winding wire referred to as a secondary winding first lead 74 and a secondary winding second lead 76. FIG. 5 is an enlarged view of one of two ends of the secondary winding 70. Notably, the high voltage transformers described heretofore may comprise a secondary winding of various cross sectional areas. For example, a secondary winding may comprise an insulated 26AWG round conductor. Alternatively, the secondary winding may be an insulated flat conductor as illustrated in FIGS. 4 and 5. The flat conductor includes a defined width w and defined thickness t, where w is greater than t. For example, an insulated flat conductor which has the equivalent cross sectional area of a 26 gauge round conductor has a width w equal to 0.036 inches and a thickness t equal to 0.007 inches. In comparison with other secondary winding conductor cross sectional configurations, such as round conductors, a flat conductor can provide more windings or turns for a given core length and given conductor cross sectional area. Stated another way, a flat conductor with a cross sectional area arrangement as illustrated in FIGS. 4 and 5 can provide more turns for a given length of transformer core than a 26 gauge round conductor of equivalent cross sectional area. All other transformer parameters being equal, the greater the number of secondary winding turns, the greater the potential voltage available at the secondary winding output leads for a given number of primary winding turns.

Figure 6:
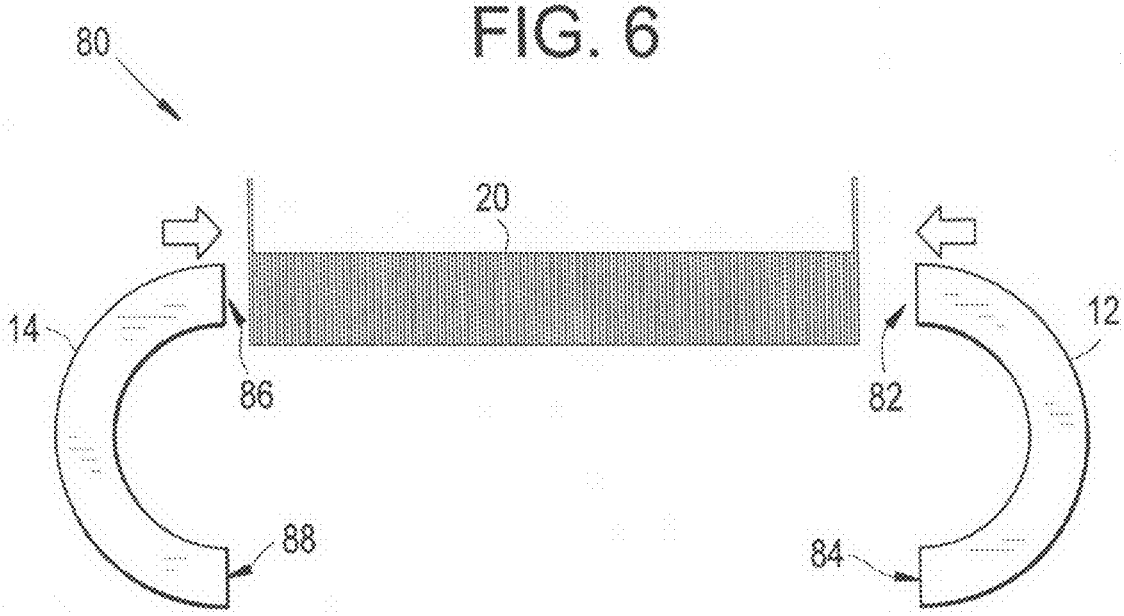
FIG. 6 is an illustration of an assembly step for assembling a toroidal shaped transformer core and associated secondary winding according to an exemplary embodiment of this disclosure.
Figure 7:
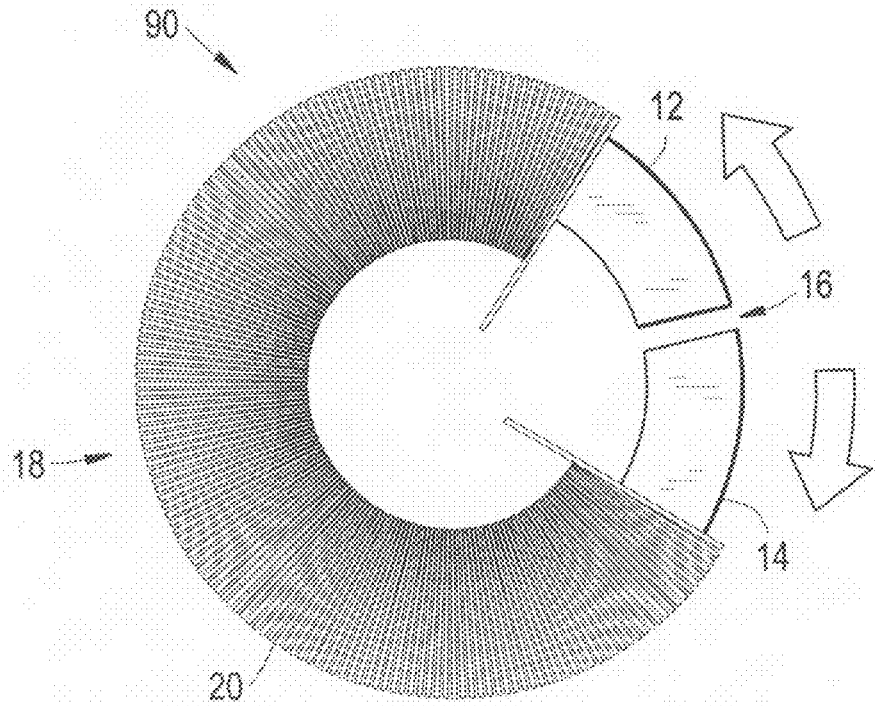
FIG. 7 is an illustration of another assembly step for assembling a toroidal shaped transformer core and associated secondary winding according to an exemplary embodiment of this disclosure.

FIG. 6 and FIG. 7 illustrate a preferred method of assembly of a toroidal shaped transformer core and associated secondary winding according to FIG. 1. Prior to assembly of the transformer, a first core member 12, second core member 14 and secondary winding 20 are provided and preferably include the attributes of the previously described figures. As shown in assembly step 80, a gap material is applied to one or both of the end faces of the core members 12, 14. For example, the gap material may be applied to all core member mating surfaces 82, 84, 86, 88. Alternatively, the gap material may be applied to only the first core member mating surfaces 82, 84, or only the second core member mating surfaces 86, 88. To assemble the transformer, one end of the first core member 12 is inserted within a first end of the secondary winding 20 and one end of the second core member 14 is inserted within a second end of the secondary winding 20. The core members 12, 14, are brought together to bond the core members (i.e., join respective end faces) to define the desired toroid shape and provide a predetermined volume or nonmagnetic gap between the core member mating surfaces 82, 84, 86, 88.

With reference to FIG. 7, the next assembly step 90 positions the secondary winding 20 on core members 12, 14 to a predetermined location. For example, positioning the secondary winding 20 to cover a first gap 16 but not the second gap 18 is desirable. As discussed with reference to FIG. 1, to further refine the performance of the transformer, positioning of the secondary winding may include coverage of a predetermined angular distance associated with the transformer core and offsetting each end of the secondary winding a predetermined dimension from the second gap 16 may be preferable. Again, other coverages and/or offsets may be desired under different requirements.

Figure 8:
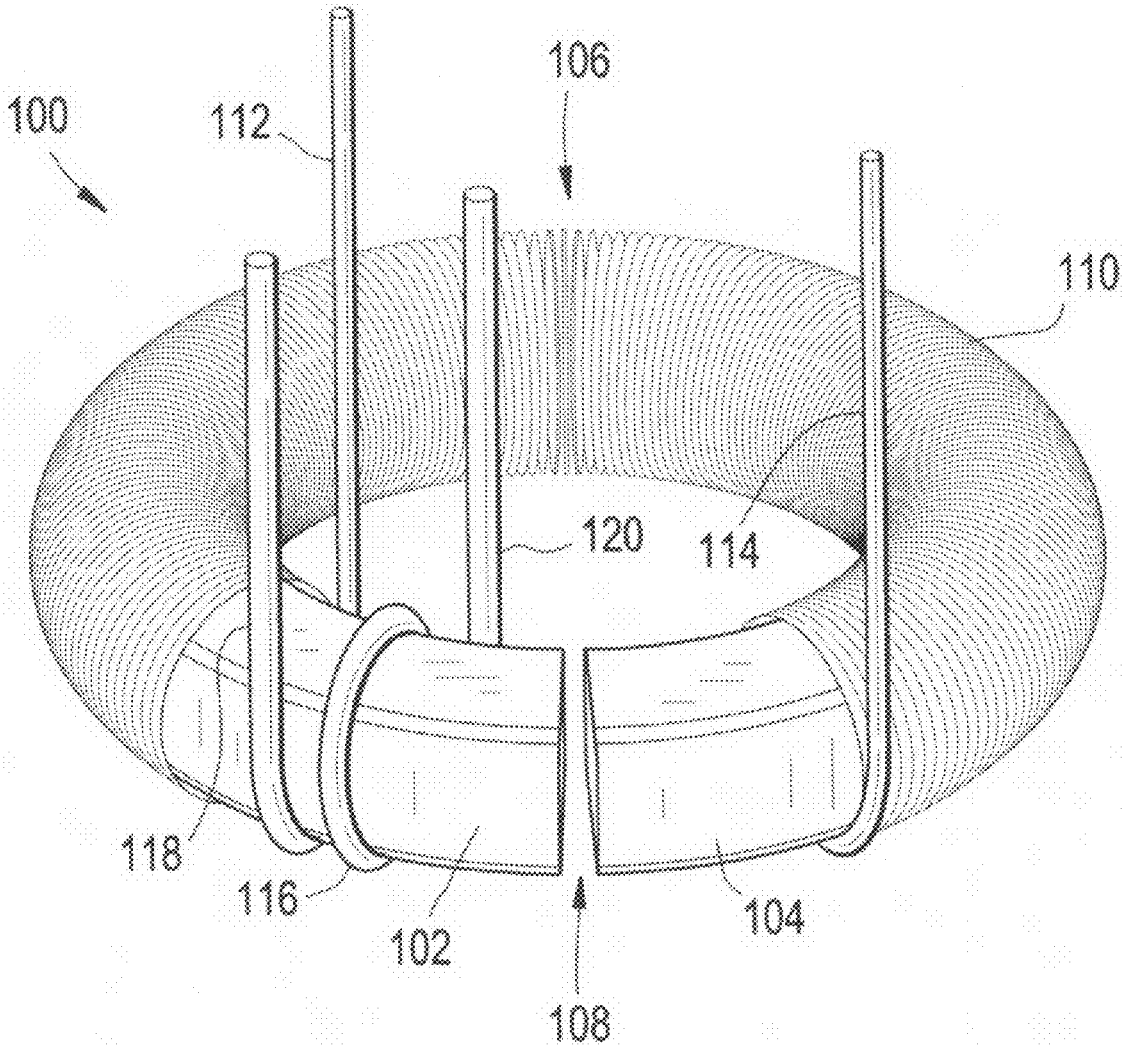
FIG. 8 is an illustration of a toroidal shaped transformer according to an exemplary embodiment of this disclosure.
Figure 9:
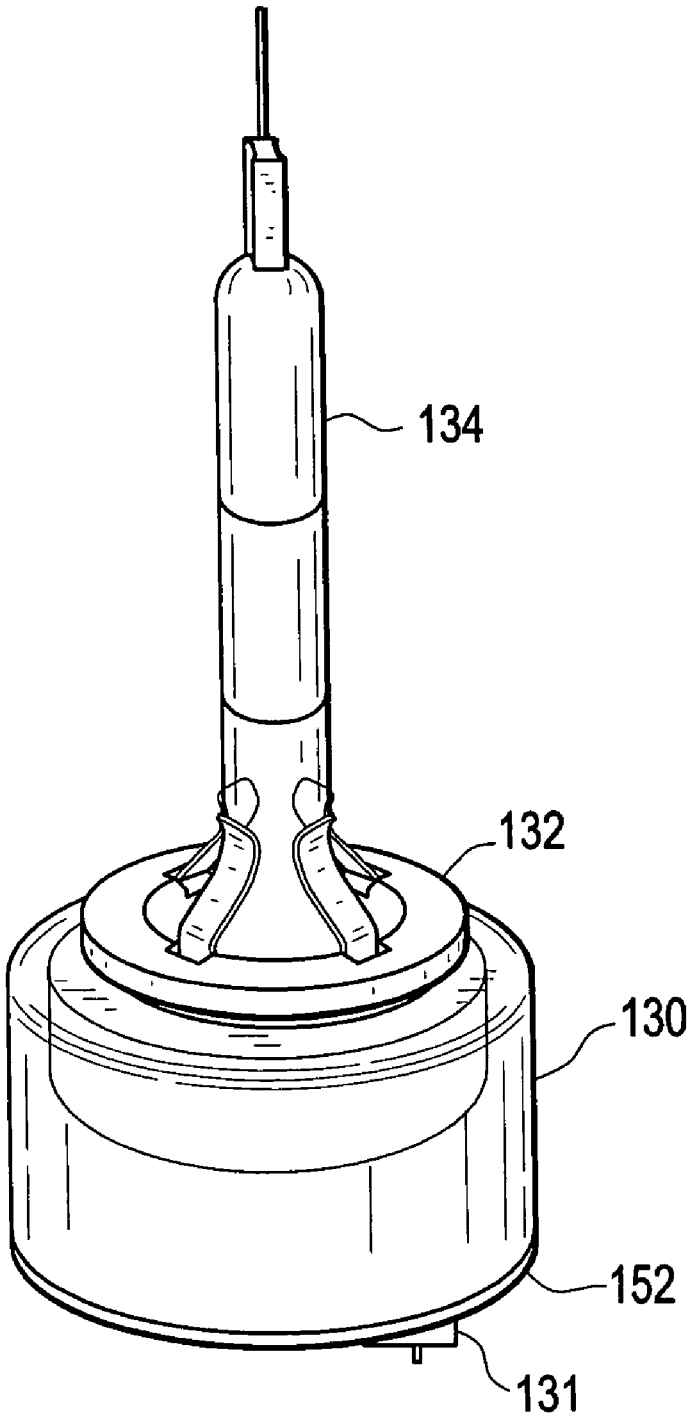
FIG. 9 illustrates an assembled lamp module including a toroidal shaped transformer according to an exemplary embodiment of this disclosure.

FIGS. 8 and 9 illustrate a toroidal shaped transformer assembly and a lamp igniter module configuration incorporating the transformer assembly. More particularly, a toroidal shaped transformer 100 has a first core member 102, a second core member 104, a first gap 106, a second gap 108, a secondary winding 110 and a primary winding 116. The secondary winding 110 is shown as an insulated helically wound conductor having a first lead 112 and a second lead 114 at opposite ends. The primary winding preferably comprises an insulated conductor including a first lead 118 and a second lead 120.

To provide for the electrical connection of the toroidal shaped transformer to a pc board, the primary and secondary leads 118, 120, 112, 114, respectively, are aligned substantially parallel to a central axis of the toroid shape.

In FIG. 9, illustrated is a lamp igniter module assembly that includes a transformer assembly within housing 130. In addition, the lamp module comprises a lamp 134, a housing lamp receiving area 132, a housing bottom cover 152, a pc board internal to the housing 130 and an external connector 131.

Figure 10A:
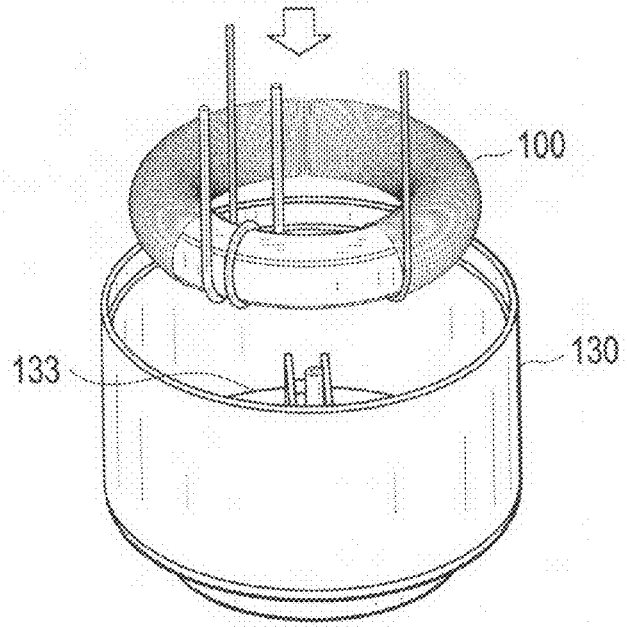
FIGS. 10A-10I are illustrations of a method of assembling a lamp module including a toroidal shaped transformer according to an exemplary embodiment of this disclosure.
Figure 10B:
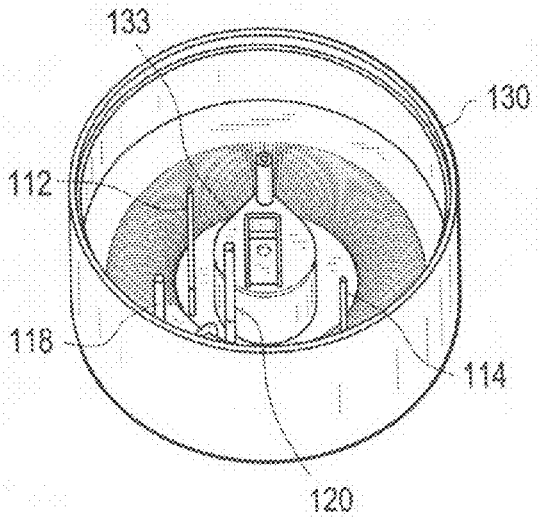

FIGS. 10A-10I more particularly illustrate a series of steps to assemble a lamp igniter module for use in a headlamp assembly and illustrated in FIG. 9. With reference to FIG. 10A, initially the toroidal shaped transformer 100 is placed within the housing 130 and positioned as illustrated in FIG. 10B with a housing lamp lead encasement 133 extending through the center of the transformer 100. At this point a high voltage potting material (not shown) is applied or poured into the housing 130 to cover the transformer 100 after the transformer has been located within the housing 130. The potting material provides additional isolation of the high voltage signals associated with the transformer secondary windings from other lower voltage components within the housing. One example of a potting material is a high voltage insulating material such as silicone, although other commercially available potting material may be alternatively used.

Figure 10C:
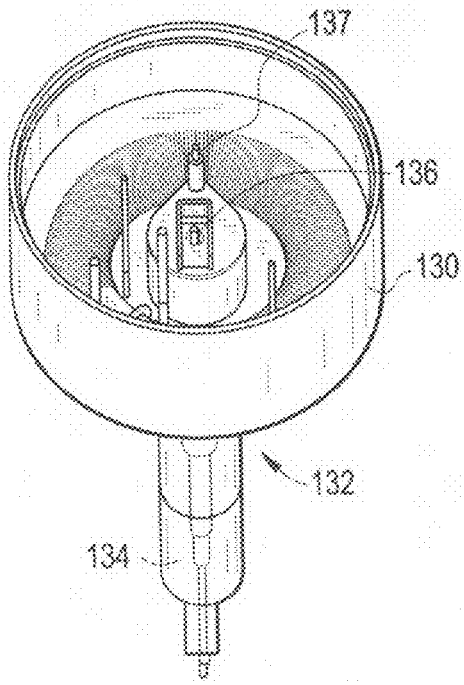
Figure 10D:
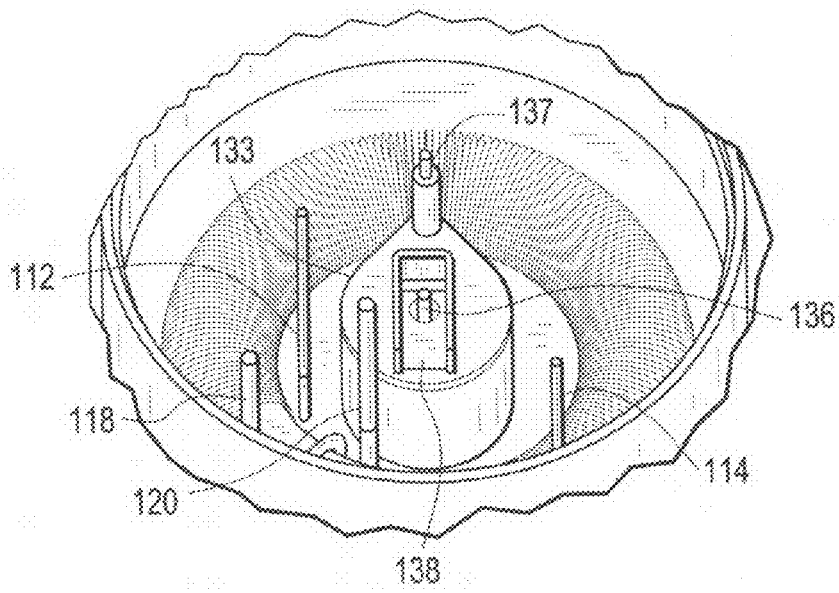

With reference to FIG. 10C, lamp 134 is inserted into the lamp receiving area 132. A lamp first lead 136 and a lamp second lead 137 are provided for connection with associated lamp leads (not shown) extending from the lamp as is well known in the art. A more detailed view of the lamp lead encasement 133, lamp electrical connections and transformer leads 112, 114, 118, 120 is shown in FIG. 10D. Specifically, the first lead 136 and second lead 137 are inserted into the lamp receiving area 132 and exit at lead guide holes located within the lamp lead encasement 133. The lamp first lead 136 is electrically connected, for example, by soldering or welding to a lead connection plate 138. Also illustrated are the approximate positions of the transformer secondary winding first lead 112, secondary winding second lead 114, primary winding first lead 118 and primary winding second lead 120.

Figure 10E:
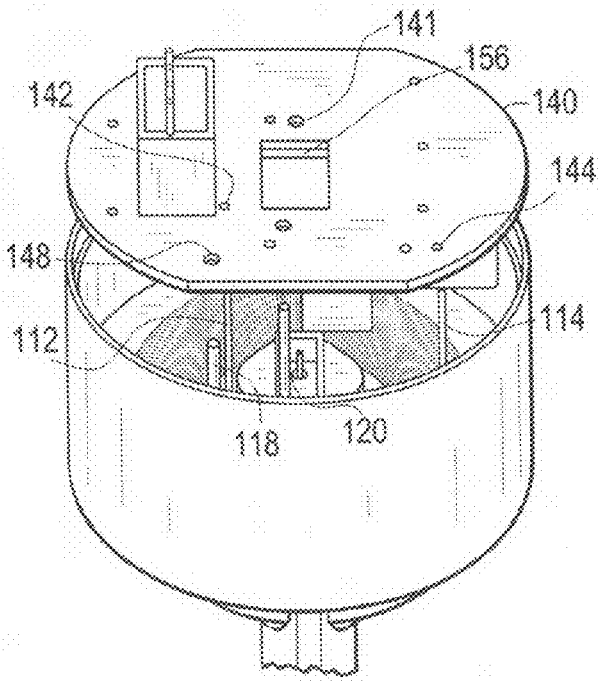
Figure 10F:
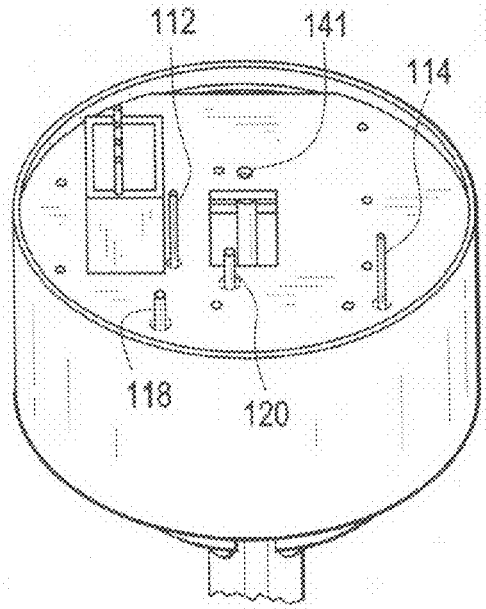

In FIG. 10E, the assembly step or placement of a lamp igniter pc board 140 within the housing 130 is illustrated. Similarly, in FIG. 10F, the alignment of the secondary winding first lead 112, the secondary winding second lead 114, the primary winding first lead 118 and primary winding second lead 120, as discussed with reference to FIG. 8, provide a relatively simple approach for electrically connecting the pc board to the appropriate transformer winding leads. Specifically, the secondary winding first lead 112 is fed through lead guide opening 142, the secondary winding second lead 114 is fed through lead guide opening 144, the primary winding first lead 118 is fed through lead guide opening 148 and the primary winding second lead 120 is fed through lead guide opening 150. In addition, a lamp lead guide opening 141 is provided on the pc board 140 to guide the lamp second lead 137 to the pc board.

Figure 10G:
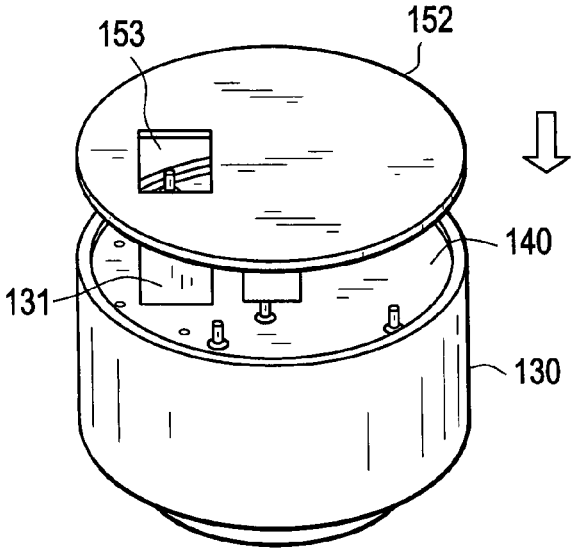

FIG. 10G illustrates the next assembly step including the placement of a housing bottom cover 152 on the housing 130. The housing bottom cover 152 comprises a cutout 153 area which provides clearance for the pc board 140 electrical connector 131. The housing bottom cover 152 may be attached to the housing 130 by means of ultrasonic welding, glue, fasteners, etc.

Figure 10H:
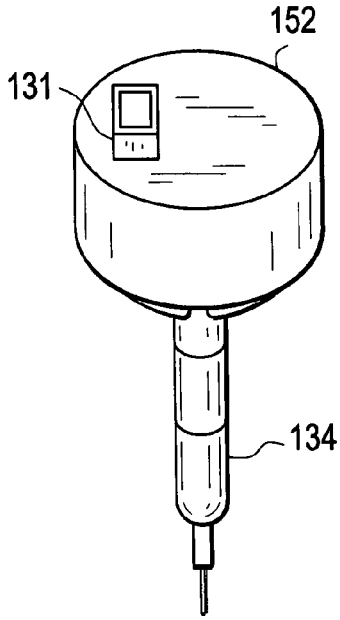
Figure 10I:
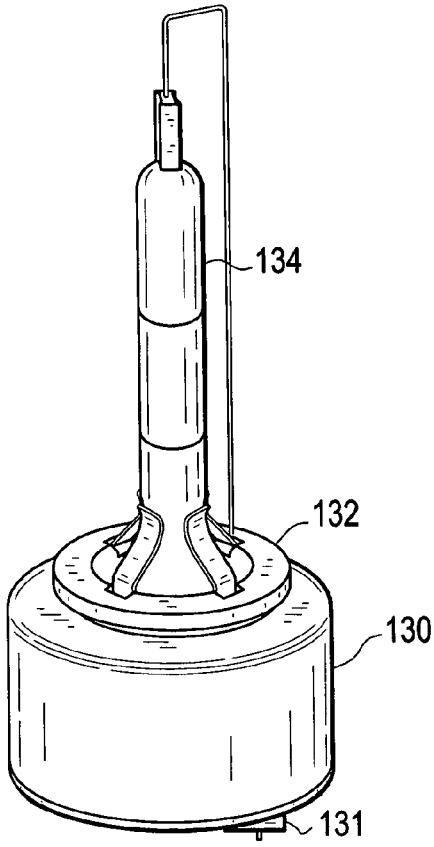

FIG. 10H shows the completed lamp igniter module and FIG. 10I illustrates a top isometric view of the completed lamp igniter module that includes the lamp 134, housing 130, connector 131, bottom cover 152 and lamp receiving area 132.

Figure 11A:
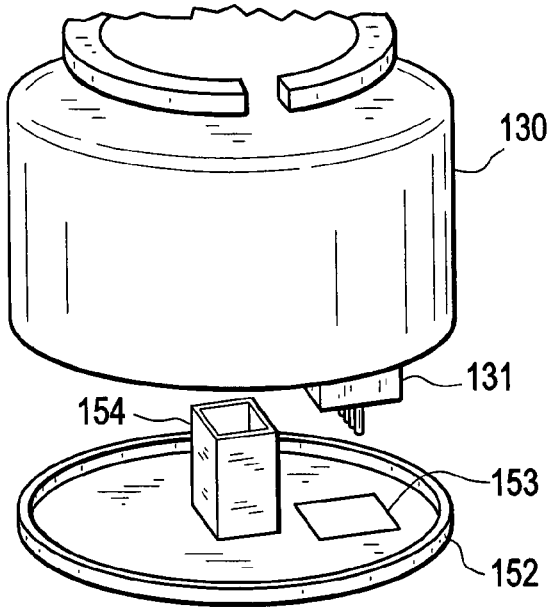
FIGS. 11A and 11B are detail views corresponding to the method of assembling a lamp module illustrated in FIGS. 10A-10I.
Figure 11B:
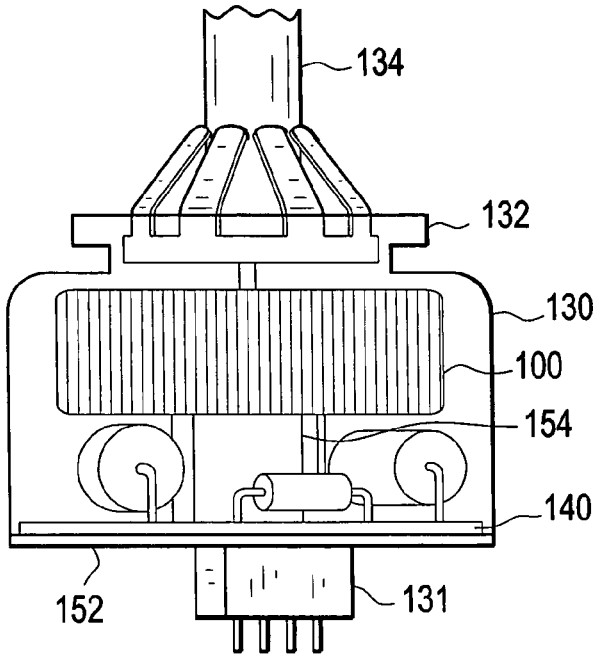

Further detail views of a lamp igniter module are shown in FIGS. 11A and 11B. The housing 130, connector 131, bottom cover 152 and bottom cover cutout 153 interconnection are illustrated. In addition, a lamp lead connection cover 154 is provided which covers the lamp first lead connection plate 138. The lamp lead connection cover 154 is preferably made of a high voltage plastic material and extends through a pc board cutout or clearance hole 156 (reference FIG. 10E) to cover and electrically isolate lamp lead electrical connection plate 138.

In FIG. 11B, the relative locations of the lamp 134, transformer 130, lamp lead connection cover 154, pc board 140, bottom cover 152 and electrical connector 131 in the completed assembly.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp transformer assembly comprising: a transformer core comprising:

two or more core members; and two or more gaps; and a primary winding and a secondary winding, the primary winding comprising one or more winding turns and the secondary winding comprising a plurality of turns, wherein the secondary winding covers the first gap and does not cover the second gap; and wherein the secondary winding covers an angular distance less than or equal to 270 degrees as measured from the center of the transformer core, and the primary winding is located substantially near a low voltage end of the secondary winding relative to a high voltage end of the secondary winding; and wherein at least one or more core members are adapted to be inserted within the interior of one or both of the primary and secondary windings, and the two or more core members and two or more gaps are positioned to operatively provide a continuous core, wherein the two or more core members and their respective ends are adapted to be operatively connected after one or more core members have been inserted within the interior of one or both of the primary and secondary windings.

2. The lamp transformer according to claim 1, further comprising:

a nonmagnetic gap material disposed within the gap.

3. The lamp transformer according to claim 2, wherein the material disposed within the gap has adhesive properties which provide bonding of the gap to each core member end.

4. The lamp transformer according to claim 2, wherein the gap material comprises glass beads.

5. The lamp transformer according to claim 2, further comprising:

a primary winding wound around a first portion of the transformer core; and a secondary winding wound around a second portion of the transformer core.

6. The lamp transformer according to claim 5, wherein the transformer comprises first and second gaps offset an angular distance of 180 degrees as measured from the center of the transformer core.

7. The lamp igniter transformer according to claim 1, wherein the primary winding comprises two turns around the transformer core and the secondary winding comprises 180 turns around the transformer core.

8. The lamp transformer assembly according to claim 1, wherein the transformer core is toroidal shaped.

9. A lamp transformer assembly comprising:

a transformer core comprising:

two or more core members; and two or more gaps interposed between the two or more core members; and a primary winding and secondary winding operatively connected to the transformer core, wherein the secondary winding comprises a flat insulated conductor having a defined width and thickness, and the flat insulated conductor is operatively connected to the transformer core to align the width in a direction substantially perpendicular to the surface of the transformer core, wherein at least a portion of the primary winding is wound over the secondary winding; and wherein the secondary winding covers an angular distance less than or equal to 270 degrees as measured from the center of the transformer core, covers the first gap and does not cover the second gap, and the primary winding is located substantially near a low voltage end of the secondary winding relative to a high voltage end of the secondary winding.

10. The lamp transformer assembly according to claim 9, wherein the flat insulated conductor comprises coating material with a dielectric strength of 6 kV's or more.

11. The lamp transformer assembly according to claim 9, the core further comprising an insulating material deposited on the surface of the core.

12. The lamp transformer assembly according to claim 11, the core insulating material and the flat insulated conductor providing approximately 30,000 volts or more of insulation between the core and flat conductor.

13. The lamp transformer assembly according to claim 11, wherein the insulating material comprises silicone.

14. The lamp transformer assembly according to claim 11, wherein the insulating material comprises layers.

15. The lamp transformer assembly according to claim 9, wherein the primary winding comprises two turns around the core and the secondary winding comprises 180 turns around the core.

16. The lamp transformer assembly according to claim 9, wherein the lamp transformer assembly is potted within a lamp igniter housing.

17. The lamp transformer assembly according to claim 16, wherein the lamp transformer assembly is electrically connected to a pc board.

18. The lamp transformer assembly according to claim 16, wherein the lamp transformer assembly is electrically connected to a lamp.

19. The lamp transformer assembly according to claim 9, wherein the transformer core is toroidal.

20. A method of assembling a lamp transformer assembly, the lamp transformer assembly comprising: a transformer core comprising first and second core members;

and a helically wound conductor;

the method comprising:

inserting a first end of the first core member into a first end of the helically wound insulated conductor; inserting a first end of the second core member into a second end of the helically wound conductor; attaching the first end of the first core member to the first end of the second core member with a nonmagnetic gap material; and attaching the second end of the first core member to the second end of the second core member with a nonmagnetic material; and positioning the helically wound insulated conductor on the transformer core at a location which covers the first gap; and positioning the secondary winding so as to cover an angular distance less than or equal to 270 degrees as measured from the center of the transformer core, positioning the secondary winding to cover the first gap and not cover the second gap, and placing the primary winding location substantially near a low voltage end of the secondary winding relative to a high voltage end of the secondary winding.

21. The method of assembling a lamp transformer assembly according to claim 20, wherein the transformer core is toroidal shaped.

22. The method of assembling a lamp transformer assembly according to claim 21, wherein the first and second gaps are symmetrically distributed.

23. The method of assembling a lamp transformer assembly according to claim 21, wherein the transformer core comprises three or more core members and three or more gaps, each core member end abutting an adjacent core member end.

24. The method of assembling a lamp transformer according to claim 21, wherein the helically wound insulated conductor comprises a flat insulated conductor, the flat insulated conductor comprising a width and a thickness, the width greater than the thickness, and the flat insulated conductor positioned on the transformer core to align the flat insulated conductor width in a direction substantially perpendicular to the surface of the core.

25. A lamp transformer assembly comprising:

a transformer core comprising:

two or more core members; and two or more gaps; and a primary winding and a secondary winding, the primary winding comprising one or more winding turns and the secondary winding comprising a plurality of turns, wherein at least a portion of the primary winding is wound over the secondary winding and the number of turns of the secondary winding is greater than the number of turns of the primary winding; and wherein the secondary winding covers an angular distance less than or equal to 270 degrees as measured from the center of the transformer core, covers the first gap and does not cover the second gap, and the primary winding is located substantially near a low voltage end of the secondary winding relative to a high voltage end of the secondary winding; and wherein one or more core members are adapted to be inserted within the interior of one or both of the primary and secondary windings, and the two or more core members and two or more gaps are positioned to operatively provide a continuous core, wherein the two or more core members and their respective ends are operatively connected after one or more core members have been inserted within the interior of one or both of the primary and secondary windings.

26. The lamp igniter transformer according to claim 25, further comprising:

a nonmagnetic gap material disposed within the gap.

27. The lamp igniter transformer according to claim 26, wherein the transformer comprises first and second gaps offset an angular distance of 180 degrees as measured from the center of the transformer core.

28. The lamp igniter transformer according to claim 25, wherein the material disposed within the gap has adhesive properties which provide bonding of the core member end to an adjacent core member end.

29. The lamp igniter transformer according to claim 25, wherein the gap material comprises glass beads.

30. The lamp igniter transformer according to claim 25, further comprising:

a primary winding wound around a first portion of the transformer core; and a secondary winding wound around a second portion of the transformer core.

* * * * *